US007025285B2

(12) United States Patent
Silverstein et al.

(10) Patent No.: US 7,025,285 B2
(45) Date of Patent: Apr. 11, 2006

(54) FIRE SPRINKLER FLOW CONTROL DEVICE

(75) Inventors: Jordan R. Silverstein, Melbourne, FL (US); Alejandro Serrano, Miami, FL (US)

(73) Assignee: University of Florida Research Foundation, Inc., Gainesville, FL (US)

( * ) Notice: Subject to any disclaimer, the term of this patent is extended or adjusted under 35 U.S.C. 154(b) by 21 days.

(21) Appl. No.: 10/690,150

(22) Filed: Oct. 21, 2003

(65) Prior Publication Data

US 2004/0163828 A1 Aug. 26, 2004

Related U.S. Application Data

(60) Provisional application No. 60/420,192, filed on Oct. 22, 2002.

(51) Int. Cl.
*F02M 47/02* (2006.01)

(52) U.S. Cl. ..... 239/90; 239/91; 169/16; 169/37; 169/51

(58) Field of Classification Search ..... 169/90, 169/91

See application file for complete search history.

(56) References Cited

U.S. PATENT DOCUMENTS 4,222,499 A * 9/1980 Lee et al. ..... 222/183
4,419,096 A * 12/1983 Leeper et al. ..... 604/132
4,423,829 A * 1/1984 Katz ..... 222/95
4,735,239 A * 4/1988 Salmon et al. ..... 141/25
5,743,337 A * 4/1998 MacDonald, III ..... 169/16

* cited by examiner

*Primary Examiner*—David A. Scherbel
*Assistant Examiner*—James S. Hogan
(74) *Attorney, Agent, or Firm*—Akerman Senterfitt; Gregory A. Nelson; Michael K. Dixon

(57) ABSTRACT

A fire sprinkler discharge control device for preventing fluids from being emitted from a fire sprinkler without having to turn off a fluid supply to the fire sprinkler. The control device may be formed from one or more bladders adapted to contain a fluid and one or more valves for passing fluids into and out of the bladder. The bladder may be adapted to fit between a support structure of a fire sprinkler and an exhaust port. Once in position, the bladder may be inflated to cut off fluid flow from an exhaust port of the fire sprinkler.

25 Claims, 2 Drawing Sheets

FIRE SPRINKLER FLOW CONTROL DEVICE

CROSS REFERENCE TO RELATED APPLICATIONS

This application claims the benefit of U.S. Provisional Application No. 60/420,192, filed Oct. 22, 2002.

FIELD OF THE INVENTION

The invention is directed generally to fire suppressant systems, and more particularly, to controlling fire sprinkler heads in commercial or residential environments after the heads have been actuated.

BACKGROUND

Many fire suppressant systems installed in commercial, residential and other structures include a fire sprinkler system that typically emits water as a fire suppressant from overhead sprinkler heads. Conventional sprinkler systems typically are comprised of a plurality of sprinkler heads connected in a systematic pattern over a protected area, an adequate water supply, and an internal piping system. Further, a typical sprinkler system is comprised of an array of branch lines that are located in the ceiling and walls of each floor of a building and supply the sprinkler heads with water. A sprinkler head can extend above a branch line, placing the sprinkler head close to the ceiling, or a sprinkler head can extend below a branch line and be mounted flush with a drop ceiling so that only a portion of the sprinkler head is exposed below the ceiling.

A conventional sprinkler head, as shown in FIG. 1, typically includes a plug for preventing water from exiting the sprinkler head, a glass bulb that holds the plug in place, and a star that diffuses the water stream so that water is dispersed in all directions relative to the sprinkler head. The glass bulb is constructed from thin glass and is positioned between a support structure of the sprinkler head and the plug. The bulb is a sealed container that houses a liquid having a low boiling point, such as between about 135 degrees Fahrenheit and about 550 degrees Fahrenheit. The bulb keeps the plug in place, thereby preventing water from being discharged from the sprinkler head. When the temperature of the ambient air surrounding the sprinkler head reaches the boiling point of the liquid contained in the glass bulb, the liquid boils, which causes the bulb to break. As the bulb breaks, the plug is released by the pressurized water in the sprinkler head. The water then flows from the port in the sprinkler head and strikes the star. The star causes the water to be dispersed in all directions. The water continues to flow from the sprinkler head until either the water source is shut off or the port in the sprinkler head is plugged.

Firefighters are often confronted with the challenge of stopping the flow of water from a sprinkler head while securing areas of a building in which there has been a fire. One common practice has been to wedge wooden wedges into the ports of the sprinkler heads to stop the water flow. This practice can damage the sprinkler head and is not preferred. Firefighters have also stopped the flow of water from a sprinkler head using a spring biased expansion device or by turning off the water supply and replacing the sprinkler head with an unused sprinkler head having an intact bulb. However, this option is only available if an unused sprinkler head is available.

Thus, a need exists for a reusable and inexpensive device capable of temporarily sealing a port in a sprinkler head after the sprinkler head has been activated.

SUMMARY OF THE INVENTION

According to one aspect of this invention, a fire sprinkler discharge control device is composed of at least one inflatable bladder configured to fit within the structural supports of a conventional fire sprinkler head or to otherwise be attached to a fire sprinkler head. The bladder is capable of receiving and holding a fluid, such as a compressed air. The bladder is configured to contact a fire sprinkler head proximate to a port through which water or other fire suppressant material flows or is emitted. The fire sprinkler discharge control device may also include one or more valves for controlling the flow of fluids into and out of the at least one inflatable bladder.

In one embodiment, the fire sprinkler discharge control device is composed of a bladder formed from inner, middle, and outer bladders, which fit within one another to form a single unit. The inner bladder receives and contains a gas or liquid, the middle bladder provides structural support to the inner bladder, and the outer bladder protects the middle bladder from wear associated with repeated use of the fire sprinkler discharge control device. The size and shape of the outer bladder determines the shape and size of the fire sprinkler discharge control device when the inner bladder is deflated. In one embodiment, the outer bladder is relatively flat in a deflated state, which enables the fire sprinkler discharge device to be inserted between a ceiling to which a fire sprinkler is mounted and a star on the fire sprinkler head.

In another embodiment, the fire sprinkler discharge control device is composed of a single bladder having a impermeable inside surface. The outer surface of the fire sprinkler discharge control device may or may not have a coating or other device for reducing wear.

The fire sprinkler discharge control device may be used by first inserting the control device between a support device of a fire sprinkler and an exhaust port. The control device may be positioned while fluids are emitted from the sprinkler or before such discharge occurs. After a fire sprinkler has been actuated, the control device may be used to shut off fluid flow from the fire sprinkler independent of other fire sprinklers by inflating the control device. The control device may be inflated using any compressed air source or other method of inflating the control device. Once the control device has been inflated, the discharge of fluids from the fire sprinkler ceases.

An advantage of this invention is that the fire sprinkler discharge control device is lightweight and portable, thereby not burdening firefighters with additional weight.

Another advantage of this invention is that the fire sprinkler discharge control device is reusable and inexpensive.

Yet another advantage of this invention is that the fire sprinkler discharge control device prevents the discharge of water from a conventional fire sprinkler head while the fire sprinkler is connected to a water supply having normal operating water pressure. The bladder design works especially well with ceiling-recessed fire sprinkler heads due to its flexibility and size enabling the device to be easily positioned.

These and other features and advantages of the present invention will become apparent after review of the following drawings and detailed description of the disclosed embodiments.

BRIEF DESCRIPTION OF THE DRAWINGS

The accompanying drawings, which are incorporated in and form a part of the specification, illustrate preferred embodiments of the presently disclosed invention(s) and, together with the description, disclose the principles of the invention(s). These several illustrative figures include the following.

DETAILED DESCRIPTION

Figure 2:
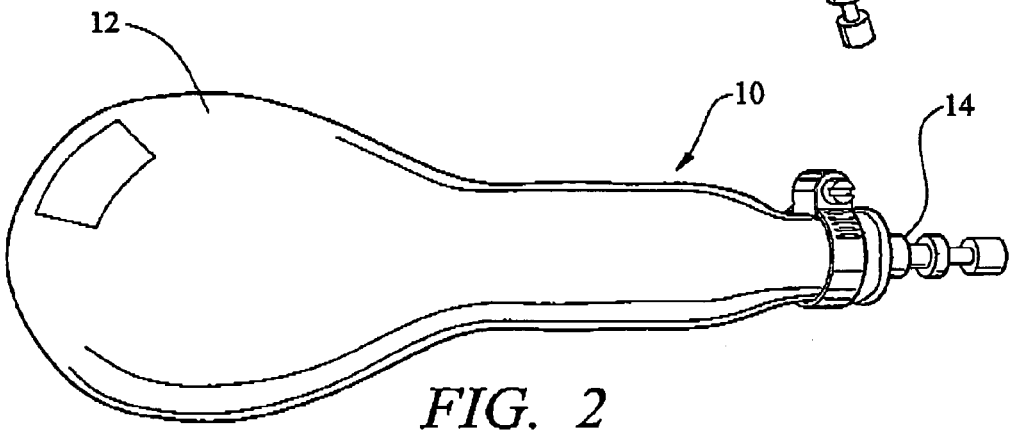
FIG. 2 is a perspective view of a fire sprinkler discharge control device of this invention in an inflated condition.
Figure 3:
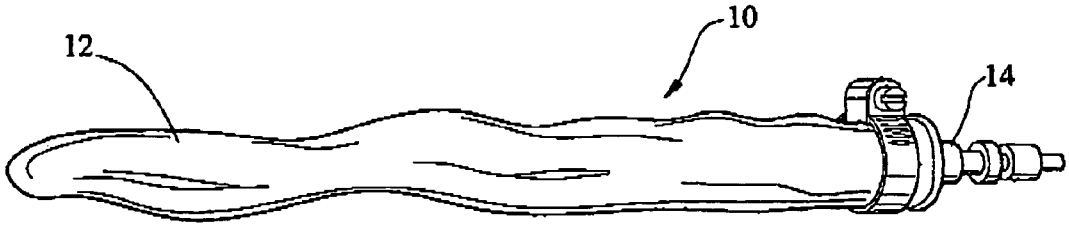
FIG. 3 is a perspective view of the fire sprinkler discharge control device of FIG. 2 in a deflated condition.
Figure 4:
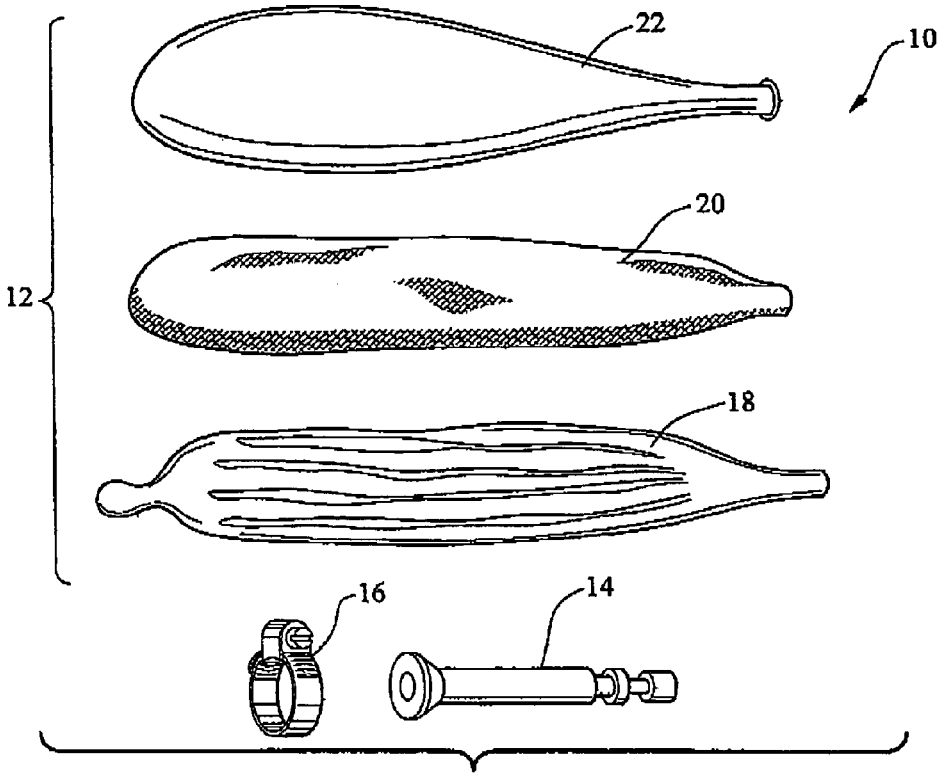
FIG. 4 is an exploded perspective view of a fire sprinkler discharge control device having inner, middle, and outer layers.

Fire sprinkler discharge control device 10, as shown in FIGS. 2–4, is an expandable bladder for preventing a fluid, such as, but not limited to, water, from flowing from an activated sprinkler head. Fire sprinkler discharge control device 10 is sized to be positioned proximate to a port in a fire sprinkler and to seal the port after the bladder has been inflated. The bladder 12 inflates upon receiving a fluid or a gas, such as, but not limited to, common air, carbon dioxide, or the like. The bladder is configured to seal the port by preventing water from exiting the port. Fire sprinkler discharge control device 10 can prevent water at pressures of 115 pound per square inch (psi) from escaping through the port and can significantly reduce the escape of water at pressures greater than 115 psi and less than or equal to about 125 psi from the port. Fire sprinkler discharge control device 10 may be formed in many configurations and sizes to accommodate any particular sprinkler head. In Fire sprinkler discharge control device 10 is particularly suited to be used with recessed sprinklers due in part to its flexibility and size enabling the device to be easily positioned.

An exemplary embodiment of the fire sprinkler discharge control device 10 is composed of a bladder 12, a valve 14, and a connection member 16, as shown in FIG. 4. Bladder 12 may be composed of one or more bladders. In one embodiment, bladder 12 may be composed of an inner bladder 18, a middle bladder 20, and an outer bladder 22. Inner bladder 18 is configured to fit within middle bladder 20, and middle bladder 20 is configured to fit within outer bladder 22. Inner bladder 18 and outer bladder 22 may be composed of any flexible materials impermeable to water and gases such as, but not limited to, latex. Inner bladder 18 is configured to contain a fluid, such as common air or carbon dioxide, and outer bladder 22 is configured to protect middle bladder 20 from the wear associated with repeated use.

The size and shape of outer bladder 22 determines the shape and size of the fire sprinkler discharge control device when the inner bladder is deflated. In one embodiment, outer bladder 22 is generally flat in a deflated state, but is generally spherical in an inflated state. Outer bladder 22 is not limited to this shape but may be formed from other shapes. In one embodiment, outer bladder 22 is relatively flat in a deflated state, which enables the fire sprinkler discharge device 10 to be inserted between a ceiling to which a fire sprinkler is mounted and a star on the fire sprinkler head.

Middle bladder 20 provides structural support to the inner bladder 18 and may be composed of flexible materials, such as, but not limited to polyester. Middle bladder 20 prevents inner bladder from deforming while inflated, thereby preventing a fluid from leaking from the port in the sprinkler head. The middle bladder 20 may be formed from numerous shapes, such as, but not limited to, spherical, elliptical, and other appropriate shapes.

Bladder 12 includes a valve 14 that is coupled to bladder 12 using connection member 16. Valve 14 may consist of any valve capable of preventing a gas or liquid from being released from bladder 12. Valve 14 should also allow a gas or fluid to be inserted into bladder 12 through valve 14. In one embodiment, valve 14 is a presta valve. In other embodiments, valve 14 includes, but is not limited to, a quick connect valve or other such valves.

Connection member 16 may be a conventional hose clamp. However, connection member 16 is not limited to this configuration. Rather, connection member 16 may be composed of, but is not limited to, a scissor clamp, a welded joint, or an expandable band, such as a conventional rubber band of sufficient strength. Alternatively, bladder 12 can be configured to form an interference fit with valve 14, thereby eliminating the need for connection member 16. In another embodiment, connection member 16 is integrally formed in valve 14.

Figure 5:
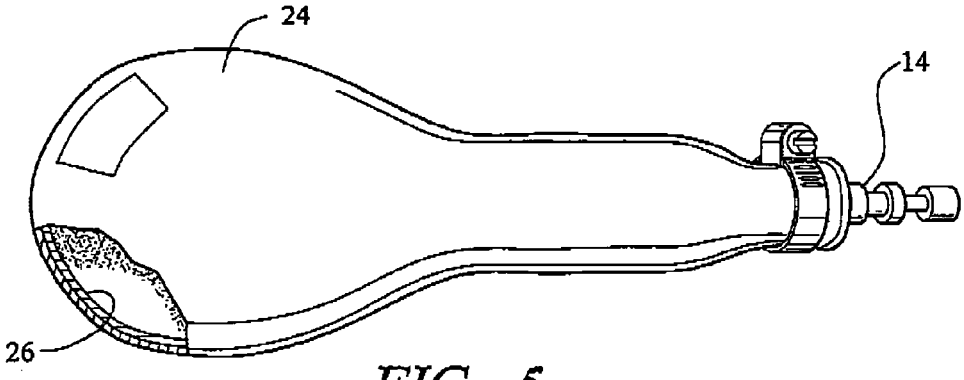
FIG. 5 is a partial cross-sectional side view of a fire sprinkler discharge control device.

In another embodiment shown in FIG. 5, fire sprinkler discharge control device 10 is composed of bladder 24 that is formed from a material, such as polyester, that is capable of providing sufficient support to prevent water from escaping a port in a fire sprinkler head. Fire sprinkler discharge control device 10 may also include an inner liner 26 that is impermeable to water, air, and other materials that may be used as a fire suppressant emitted from a fire sprinkler. Inner liner 26 may be a separate and distinct liner, a coating applied to the inner surface of bladder 24, or an integral part of bladder 24. Inner liner 26 preferably is expandable. Fire sprinkler discharge control device 10 may or may not additionally include an outer coating applied to bladder 24. The outer coating maybe spray applied to bladder 24 or applied using another process and may be composed of any material capable of increasing the life and durability of bladder 24, such as, but not limited to, latex or other materials.

Figure 1:
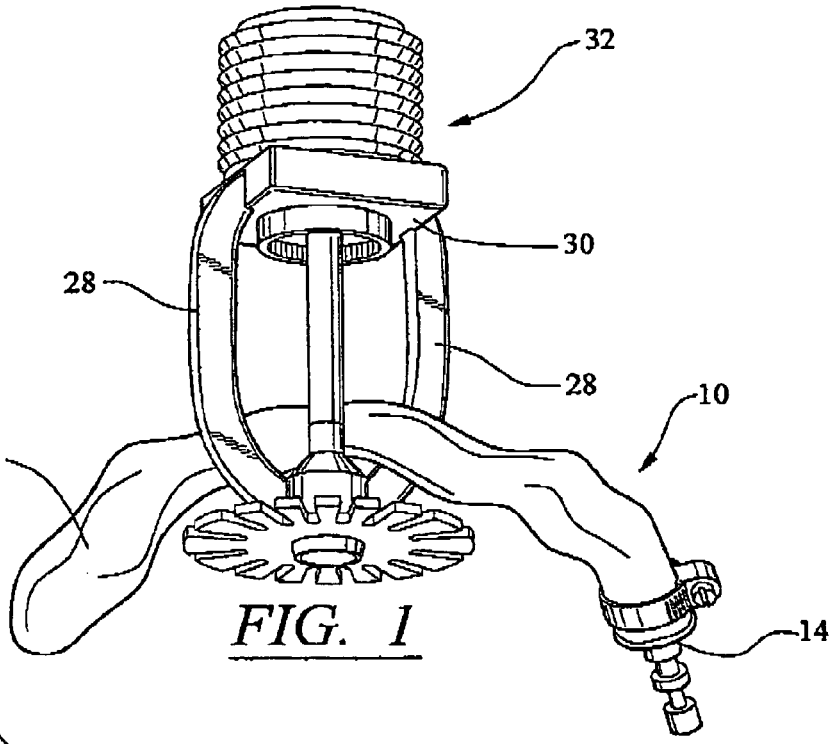
FIG. 1 is a perspective view of a conventional fire sprinkler head.

As shown in FIGS. 2–4, bladder 12 is sized to fit between support structure 28 and port 30 of a conventional fire sprinkler head 32, shown in FIG. 1, when bladder 12 is deflated. The fire sprinkler discharge control device 10 may be used to stop a liquid or gas from flowing from port 30 of conventional fire sprinkler head 32 after the fire sprinkler head 32 has been activated. While a gas or a liquid, such as, but not limited to, water, is flowing from port 30, bladder 12 is positioned between support structure 28 and port 30. Bladder 12 is filled with a liquid or gas. In one embodiment, bladder 12 is filled with a compressed gas, such as, but not limited to, common air or carbon dioxide, by connecting valve 14 to a supply source.

The supply source may be any device capable of supplying a liquid or gas to bladder 12, such as, but is not limited to, a rechargeable canister, a disposable canister, a compressor, or other such device. The supply source may be further be capable of providing pressure at least equal to the water pressure found in the fire sprinkler system.

Fire sprinkler discharge control device 10 may be used to control the flow of a fluid from a recessed fire sprinkler head. To control the flow of fluid in this manner, bladder 12 must first be positioned between support structure 28 and port 30.

This may be accomplished by inserting bladder 12 between a ceiling in which the fire sprinkler head is mounted and the star of a conventional recessed sprinkler head. The bladder 12 may be inserted using an applicator, which may be a small thin device, such as, but not limited to, a tongue depressor, dowel, shaft or other such device. The applicator is used to assist in inserting bladder 12 through the small opening between the star and the ceiling in which the sprinkler head is mounted.

As the liquid or gas is injected through valve 14 into bladder 12, bladder 12 expands and seals port 30 by pressing the outside surface of bladder 12 against the outer surface of sprinkler head 32 proximate to port 30, thereby preventing a liquid, such as water, from flowing through port 30. Expanded bladder 12 remains in this position until the gas or liquid contained within bladder 12 is released, thereby deflating bladder 12. Typically, expanded bladder 12 is not deflated and removed from port 26 until the water supply to the sprinkler head is shut off. Once the water supply is shut off, bladder 12 can be deflated and removed. The actuated sprinkler can then be replaced with a sprinkler head having a bulb intact.

The foregoing is provided for purposes of illustrating, explaining, and describing embodiments of this invention. Modifications and adaptations to these embodiments will be apparent to those skilled in the art and may be made without departing from the scope or spirit of this invention or the following claims.

The invention claimed is:

1. A fire sprinkler discharge control device, comprising:

at least one bladder adapted to fit between a support structure of a fire sprinkler and an exhaust port of a fire sprinkler for sealing the exhaust port of the fire sprinkler by contacting an outer surface of the at least one bladder with the exhaust port, wherein the support structure extends outwardly from the fire sprinkler in front of the exhaust port.

2. The fire sprinkler discharge control device of claim 1, further comprising at least one valve coupled to the at least one bladder for controlling flow of a fluid into and out of the at least one bladder.

3. The fire sprinkler discharge control device of claim 2, wherein the at least one valve is a presta valve.

4. The fire sprinkler discharge control device of claim 2, wherein the at least one valve is coupled to the at least one bladder using a clamp.

5. The fire sprinkler discharge control device of claim 1, wherein the at least one bladder comprises an inner bladder and an outer bladder.

6. The fire sprinkler discharge control device of claim 5, wherein the inner bladder is impermeable to fluids.

7. The fire sprinkler discharge control device of claim 6, wherein the inner bladder is comprised of latex.

8. The fire sprinkler discharge control device of claim 5, wherein the outer bladder forms a wear resistant boundary comprised of latex.

9. The fire sprinkler discharge control device of claim 5, further comprising at least one middle bladder positioned between the inner bladder and the outer bladder, wherein the at least one middle bladder provides structural support to the fire sprinkler discharge control device.

10. The fire sprinkler discharge control device of claim 9, wherein the at least one middle bladder is comprised of polyester.

11. The fire sprinkler discharge control device of claim 5, further comprising a wear resistant coating applied to an outer surface of the outer bladder.

12. The fire sprinkler discharge control device of claim 1, further comprising an inner liner positioned inside the at least one bladder, wherein the inner liner is impermeable to fluids.

13. A fire sprinkler discharge control device, comprising:

at least one outer bladder adapted to fit between a support structure and an exhaust port of a fire sprinkler for sealing the exhaust port by contacting an outer surface of the at least one bladder with the exhaust port, wherein the support structure extends outwardly from the fire sprinkler in front of the exhaust port;

at least one inner bladder impermeable to fluids and positioned in the at least one outer bladder; and at least one valve coupled to the at least one bladder for controlling flow of a fluid into and out of the at least one bladder.

14. The fire sprinkler discharge control device of claim 13, wherein the inner bladder is comprised of latex.

15. The fire sprinkler discharge control device of claim 13, wherein the outer bladder forms a wear resistant boundary comprised of latex.

16. The fire sprinkler discharge control device of claim 13, further comprising at least one middle bladder positioned between the inner bladder and the outer bladder, wherein the at least one middle bladder provides structural support to the fire sprinkler discharge control device.

17. The fire sprinkler discharge control device of claim 16, wherein the at least one middle bladder is comprised of polyester.

18. The fire sprinkler discharge control device of claim 13, wherein the at least one valve is a presta valve.

19. The fire sprinkler discharge control device of claim 13, wherein the at least one valve is coupled to the at least one bladder using a clamp.

20. The fire sprinkler discharge control device of claim 13, further comprising a wear resistant coating applied to an outer surface of the outer bladder.

21. A method of controlling discharge of fluids from a fire sprinkler, comprising:

inserting a fire sprinkler discharge control device between a support structure of the fire sprinkler and an exhaust port of the fire sprinkler, wherein the support structure extends outwardly from the fire sprinkler in front of the exhaust port;

inflating the fire sprinkler discharge control device positioned proximate to the exhaust port of a fire sprinkler so that at least a portion of at least one bladder forming the fire sprinkler discharge control device contacts the exhaust port and prevents at least a substantial portion of the fluids from being discharged from the exhaust port of the fire sprinkler.

22. The method of claim 21, further comprising positioning the fire sprinkler discharge device between a support structure of the fire sprinkler discharge device and the exhaust port.

23. The method of claim 21, wherein positioning the fire sprinkler discharge device between a support structure of the fire sprinkler discharge device and the exhaust port further comprises using an applicator to assist in positioning the fire sprinkler discharge device.

24. The method of claim 21, wherein inflating a fire sprinkler discharge control device comprises injecting a gas into the device from a compressed gas source.

25. The method of claim 24, further comprises releasably attaching a fitting to a valve attached to the fire sprinkler discharge control device.

* * * * *